US005788366A

United States Patent [19]

Rabl et al.

[11] Patent Number: 5,788,366

[45] Date of Patent: Aug. 4, 1998

[54] PROCESS FOR THE PRODUCTION OF REFLECTIVE ELEMENTS OF A LIGHT AND LIGHTS OBTAINED ACCORDING TO THIS PROCESS

[75] Inventors: Ari Rabl, Bures-sur-Yvette, France; Jeff Miles Gordon, Sede Boger Campus, Israel

[73] Assignee: Association pour la Recherche et le Developpement des Methodes et Processus Industriels - A.R.M.I.N.E.S., Paris Cedex, France

[21] Appl. No.: 491,586

[22] Filed: Jun. 16, 1995

[30] Foreign Application Priority Data

Jun. 24, 1994 [FR] France ..... 94 07809

[51] Int. Cl.[6] ..... F21V 7/00

[52] U.S. Cl. ..... 362/347; 362/217; 362/297; 362/346

[58] Field of Search ..... 362/217, 297, 362/298, 304, 346, 347, 348

[56] References Cited

U.S. PATENT DOCUMENTS 4,173,036 10/1979 Ferguson ..... 362/259

FOREIGN PATENT DOCUMENTS 0 440 379 8/1991 European Pat. Off. .
2 249 572 4/1974 Germany .

*Primary Examiner*—Stephen F. Husar
*Attorney, Agent, or Firm*—Young & Thompson

[57] ABSTRACT

The present invention relates to a process for the production of the profile of reflective elements of a light as well as the lights obtained by this process, the light comprising at least two cylindrical reflective elements (5, 5'). This process is characterized in that it comprises the steps consisting of:

defining the position of one end ($R_o$) of the profile of each reflective element (5, 5')

defining an illumination function E(θ) corresponding to a desired illumination curve, connected to a luminance function L(θ) by the formula:

$$E(\theta)=L(\theta)\cdot\cos^2\theta=k[s\cdot\cos\theta+\rho r\cdot\sin(\phi-\theta)-\rho r_o\sin(\phi_o-\theta)]\cos^2\theta$$

if said end (Ro) of the profile of the reflective element (5, 5') is the downstream end of this latter, and an illumination function:

$$E(\theta)=L(\theta)\cdot\cos^2\theta=k[s\cdot\cos\theta-\rho r\cdot\sin(\phi-\theta)+\rho r_o\cdot\sin(\phi_o-\theta)]\cos^2\theta$$

if said end (Ro) is the upstream end of said profile determining, from said end (Ro), the coordinates of each of the points (R) of said profile of each reflective element (5, 5') satisfying the differential equation:

$$d\alpha/d\theta=\sin\alpha\cdot\cos\alpha[d\log p(\theta)/d\theta]-\sin^2\alpha,$$

in which the function p(θ) is equal to ρr·sin(ϕ−θ) and the value of the angle α is equal to (ϕ−θ)/r.

5 Claims, 3 Drawing Sheets

PROCESS FOR THE PRODUCTION OF REFLECTIVE ELEMENTS OF A LIGHT AND LIGHTS OBTAINED ACCORDING TO THIS PROCESS

The present invention relates to a process for the production of the profile of reflective elements of a light adapted to illuminate a target surface with substantially any desired illumination profile. The present invention relates also to reflectors produced according to such a process.

There are known different types of reflectors for lights whose profiles are such as to permit obtaining, on a target surface, from cylindrical light sources or concentrated flat light sources, an illumination profile, or illumination curve, which one would wish to be constant overall but which, for various reasons only very rarely achieves an illumination uniformity of about 80%.

These lights have substantial drawbacks. On the one hand, they are not able to illuminate a target surface with any desired lighting profile, and on the other hand, the hardly uniform lighting which they supply is obtained only over a relatively reduced surface.

The present invention has for its object to provide means permitting producing a light which, from an extended light source, supplies over a spaced target surface a lighting curve of practically any profile and particularly a constant illumination, and this without increasing substantially the size.

The present invention thus has for its object a process for the production of the profile of reflective elements of a light constituted by a flat light source symmetrical relative to a plane, of at least two cylindrical reflective elements, each point of the profile being defined by the length (r) of the segment representing the distance of the end of the cross section of said light source, located beside said reflective element, to said point, and by the angle ($\phi$) formed by the vertical with said segment, the light beams from the light source forming, at the output of the light, respective angles ($\theta$) with said plane, characterized in that it comprises the steps consisting:

in defining the position of one end of the profile of each reflective element, from on the one hand a desired distance ($r_O$) separating said end from the end of the cross section of said light source situated on the side of said reflective element and, on the other hand, from an angle over which one desires to see the width (s) of said light source from the end of said profile, in defining an illumination function $E(\theta)$ corresponding to a desired lighting profile, associated with a luminance $L(\theta)$ by the formula:

$$E(\theta)=L(\theta)\cdot\cos^2\theta=k[s\cdot\cos\theta+\rho r\cdot\sin(\phi-\theta)-\rho r_o\cdot\sin(\phi_o-\theta)]\cos^2\theta$$

if said end of the profile of the reflective element is the downstream end of the latter, and an illumination function:

$$E(\theta)=L(\theta)\cdot\cos^2\theta=k[s\cdot\cos\theta-\rho r\cdot\sin(\phi-\theta)+\rho r_o\cdot\sin(\phi_o-\theta)]\cos^2\theta$$

if said end is the upstream end of said profile, in which k=L(O)/s in determining, from said end, the coordinates of each of the points of said profile of each reflective element satisfying the differential equation:

$$d\alpha/d\theta=\sin\alpha\cdot\cos\alpha[d\log p(\theta)/d\theta]-\sin^2\alpha,$$

in which the function $p(\theta)$ is equal to $\rho r\cdot\sin(\phi-\theta)$ and the value of the angle $\alpha$ is equal to $(\phi-\theta)/r$.

In one embodiment of practicing the invention, said flat light source is constituted by a virtual image obtained from a cylindrical light source of circular cross section and from a primary reflector having the developed shape of a circle.

The present invention also has for its object a light constituted by a flat light source, symmetrical relative to a plane, and by at least two cylindrical reflective elements, each point of the profile of a reflective element being defined by the length (r) of the segment representing the distance from the extremity of the cross section of said light source, located beside said reflective element, to said point, and by the angle ($\phi$) formed by the vertical with said segment, in which the light beams from the flat light source form, at the output of the light, respective angles ($\theta$) with said plane, characterized in that an end of said profile of said reflective element is positioned at a desired distance ($r_o$) from said end (0) of the cross section of said light source, such that, from this end, the width (s) of said light source will be seen under a desired angle, the coordinates of each of the points of the profile of each of the reflective elements are defined from a given illumination function $E(\theta)$ determined by a desired lighting curve, connected to a luminance function $L(\theta)$ by the relationship:

$$E(\theta)=L(\theta)\cdot\cos^2\theta=k[s\cdot\cos\theta+\rho r\cdot\sin(\phi-\theta)-\rho r_o\cdot\sin(\phi_o-\theta)]\cos^2\theta$$

if said end of the profile of the reflective element is the downstream end of this latter, and an illumination function:

$$E(\theta)=L(\theta)\cdot\cos^2\theta=k[s\cdot\cos\theta-\rho r\cdot\sin(\phi-\theta)+\rho r_o\cdot\sin(\phi_o-\theta)]\cos^2\theta$$

if said end is the upstream end of said profile, wherein k=L(O)/s and satisfying the differential equation:

$$d\alpha/d\theta=\sin\alpha\cdot\cos\alpha[d\log p(\theta)/d\theta]-\sin^2\alpha,$$

in which the function $p(\theta)$ is equal to $\rho r\cdot\sin(\phi-\theta)$ and the value of the angle $\alpha$ is equal to $(\phi-\theta)/r$.

The present invention thus permits controlling the illumination supplied to a target surface. Such illumination could be symmetrical or not relative to the plane of symmetry of the light source, the profiles of the reflective elements of a same light being adapted for this purpose to have different shapes.

The present invention is particularly interesting in the case in which the target surface must be illuminated in a uniform fashion by several adjacent lights whose end illuminations must overlap with a good tolerance permitting easy positioning of the lights.

The present invention uses flat light sources. However, in practice, there are mostly available light sources having the shape of cylinders of revolution such as, for example, those constituted by fluorescent tubes. The present invention permits using such sources with the light according to the invention because it is known that any convex source can be replaced, as to optics, by an equivalent flat source if it is coupled with a specular reflector in the developed shape of a circle.

In such an embodiment of practice, the present invention permits distancing the cylindrical light source from the internal surface of the specular reflector, while preserving the desired illumination profile, by introducing into the illumination function $E(\theta)$ an illumination correction function $Fc(\theta)$ . One can thus protect the reflector from heat given off by the light source.

There will be described hereafter, by way of non-limiting example, an embodiment of the present invention, referring to the accompanying drawing, in which.

Figure 5A:
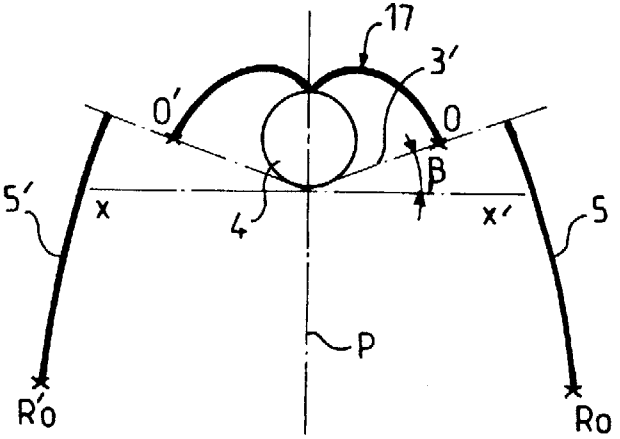
Figure 4:
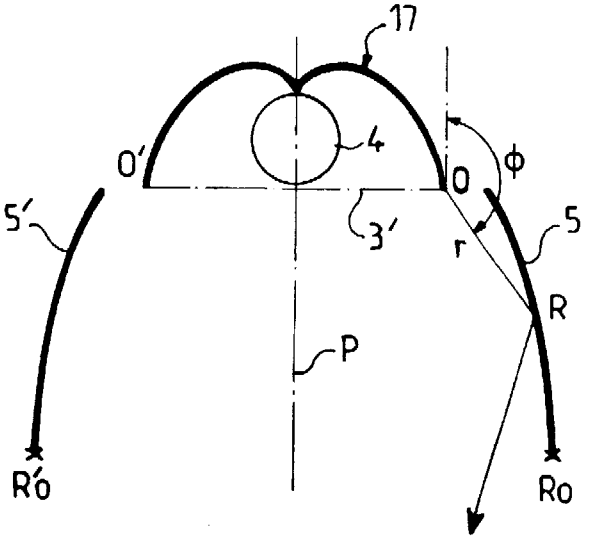
FIG. 4 is a view in cross section, on a larger scale, of an embodiment of practicing the invention.

FIG. 5*a* is a cross-sectional view, on an enlarged scale, of a modification of the mode of practicing the invention shown in FIG. 4.

Figure 5B:
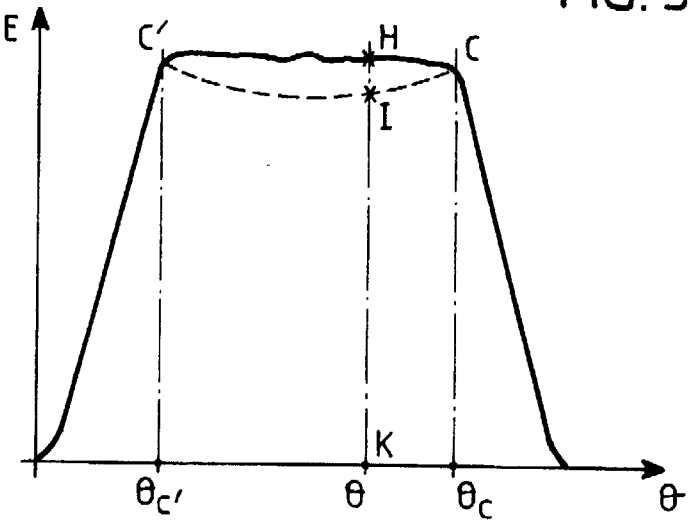

FIG. 5*b* is a graph representing the illumination curve delivered by a cross section of a light according to the invention.

Figure 6:
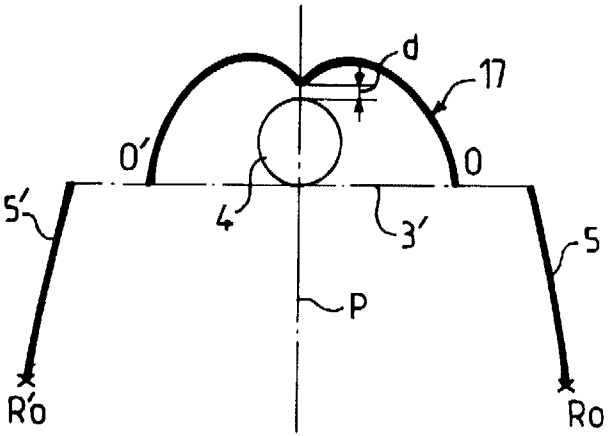

FIG. 6 is a cross-sectional view on a larger scale showing a modified embodiment of the device according to the invention.

Figure 7:
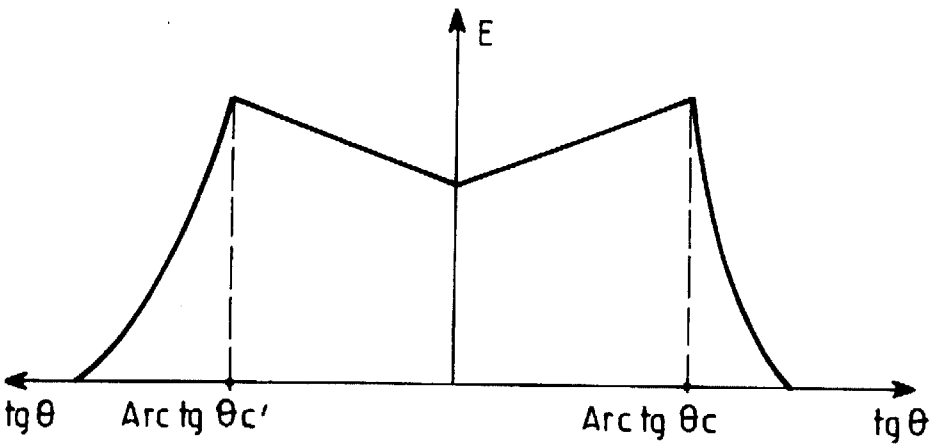

FIG. 7 is a schematic view showing the illumination curve produced by a light according to the invention.

Figure 8:
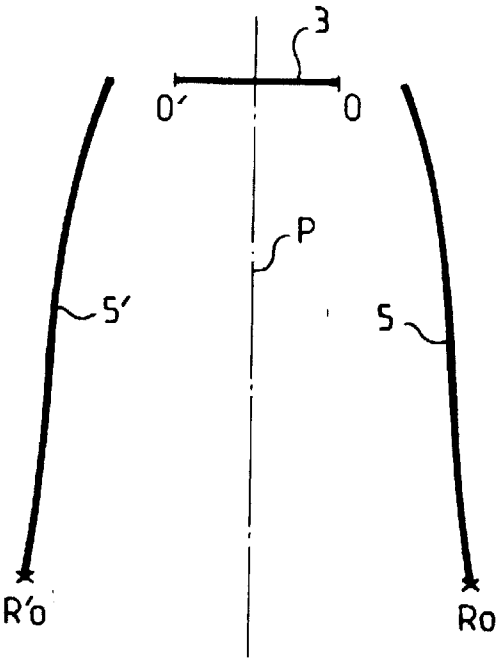

FIG. 8 is a view on a larger scale of a cross section of a light according to the invention adapted to reproduce the illumination curve shown in FIG. 7.

Figure 9:
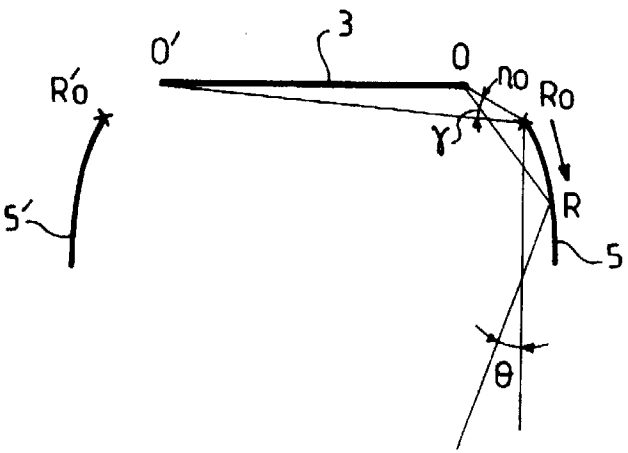

FIG. 9 is a cross-sectional view, on a larger scale, of an embodiment of the invention.

Figure 1:
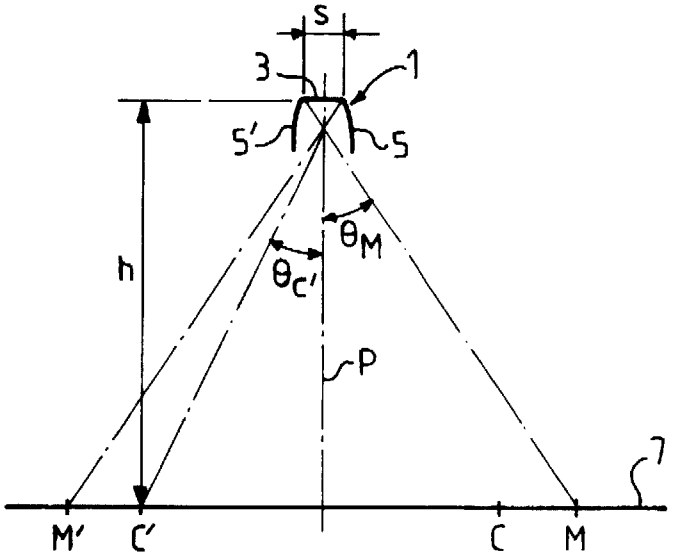
FIG. 1 is a schematic view showing a light of the type of that of the invention, illuminating a target surface.
Figure 2:
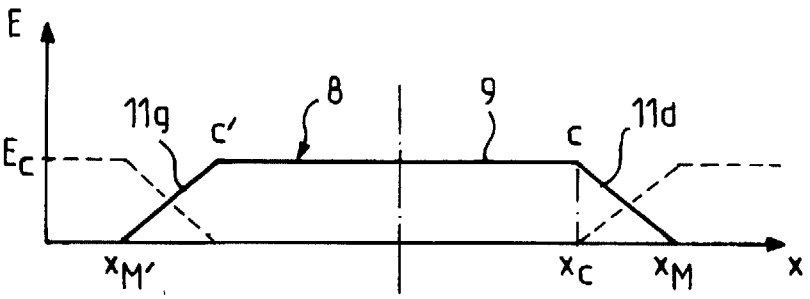
FIG. 2 is a graph representing the lighting profile, or illumination curve, taken in cross section on a light according to the invention.
Figure 3:
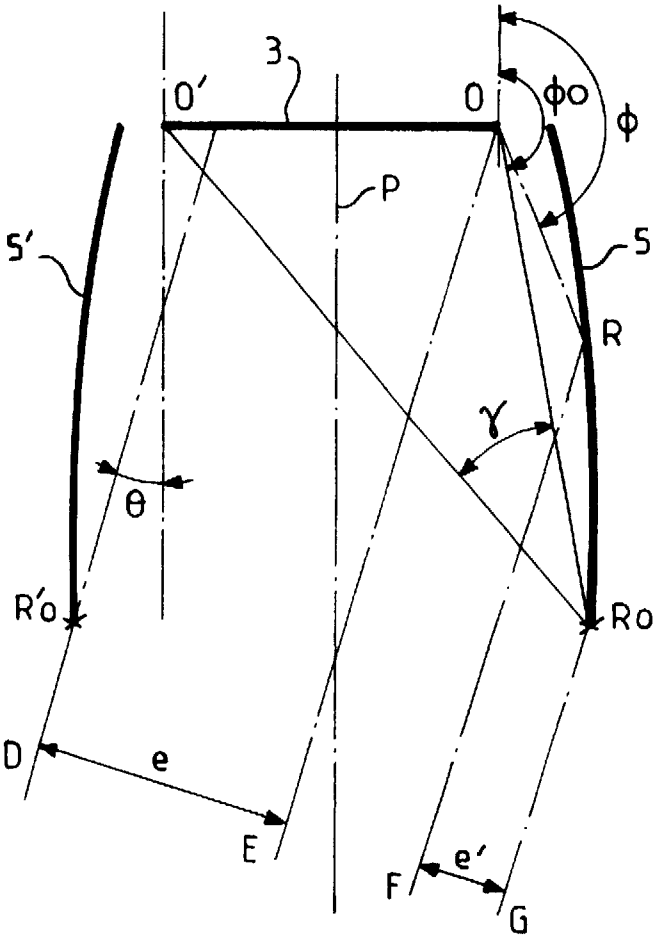
FIG. 3 is a cross-sectional view, on a larger scale, of a light according to the invention.

There is shown in FIGS. 1 to 3 a light 1 constituted by a flat light source 3 and two cylindrical reflective elements 5 and 5' whose cross sections, or profiles, are symmetrical relative to the plane of symmetry (P) of the source 3. This light 1 is adapted to illuminate a target surface 7, disposed at a distance h from the light source 3, this distance being considered as increased relative to the width s of the source 3, which is to say that it is of the order of at least ten times that latter.

The light 1 is adapted to illuminate the target surface 7 with an illumination curve shown in FIG. 2. This illumination curve, which represents the value of illumination delivered to the target surface 7 across its transverse dimension, is constituted by a central plateau 9 between two lateral downwardly outwardly inclined legs 11*g* and 11*d*. This illumination curve shows that the target surface 7 will be illuminated in a uniform manner between the points C' and C and that on opposite sides of the latter the illumination diminishes progressively to become zero at end points M' and M. Although there is shown in the diagram of FIG. 2 only a single cross section of the light 1 and of the target surface 7, these latter will be identical in any other cross section.

As shown in FIG. 2, the legs 11*g* and 11*d* permit easily associating two adjacent lights, so as to produce an overall illumination equal to the sum of the illumination supplied by each of the lights, which is constant over the target surface 7.

Of course the reflective elements according to the process and device of the invention permit producing a light adapted to reproduce, between the points C and C', any other illumination curve.

A first step of the process according to the invention consists in determining the coordinates of an end edge Ro of each of the reflective elements 5 and 5' and in the present case there will be chosen the downstream edge. In practice, the position of this latter will depend essentially on two parameters, namely the angle γ under which, from the point Ro, it is desired to see the width s of the light source 3, and the distance ro separating the point Ro from the end 0 of the light source 3 nearest the reflective element in question. Preferably, the angle γ will be greater than the angles $\theta_c$ and θc' under which will be seen, from the center of the light 1, the end points C and C' of the target surface 7 between which it is desired to control the light curve.

The applicant has established that the angle φo formed by the vertical with the straight line joining the point O to the point Ro was defined by the formula:

$$\phi_o = 180° - \text{Arc sin}\left(\cos\gamma\sqrt{1-[r_o \sin\gamma/s]^2}\right) - (r_o/s)\sin^2\gamma$$

According to the invention, once the downstream end Ro of the profile of the cross section of the reflective element 5 is determined, the construction can be ensured point by point by passing toward the upstream end of said profile namely by following the curve Roz.

This construction is produced by introducing, for each point R, the characteristic of the desired illumination curve, according to an equation defined hereinafter.

In the particular case of the example selected for FIGS. 1 to 3, the illumination received by the target surface 7 is constant for each of its points comprised between C and C'. Each of these points can be defined by the beams from the center of the light and bordering on this point and forming with the vertical an angle θ.

The illumination curve of the target surface 7 is thus defined between the end angles θc' and θc corresponding to the end points C' and C of the target surface 7. The luminance L(θ) supplied to a point on the target surface 7 corresponding to a given angle θ is equal to the incident luminance $L(\theta)_i$ from the beams emitted directly from the light source 3 without being subjected to reflection on the reflective element 5, added to the reflected luminance $L(\theta)_r$ from the beams transmitted after reflection ($L(\theta)=L(\theta)_i+L(\theta)_r$).

In FIG. 3, this luminance L(θ) is proportional to the sum of the distance e=DE=s·cos θ and of the distance e'=FG=r·sin(φ−θ)−r·sin (φ$_o$−θ), so that the luminance at a given point on the target surface of angle θ is:

$$L(\theta)=k(e+e')=k[s\cos\theta+\rho\cdot r\sin(\phi-\theta)-\rho r_o\cdot\sin(\phi_o-\theta)]$$

in which ρ is a constant characteristic of the coefficient of reflectivity of the surface of the light, related to the nature of this latter and its surface condition.

The constant k can be expressed as being equal to the luminance L(θ) supplied by beams parallel to the plane of symmetry P of the light 1 in which θ=0. Thereafter:

$$k=L(0)/s$$

As to the illumination E(θ) received at a point on the target comprised between the end points C and C' and forming an angle θ with the plane of symmetry P of the light, this is equal to:

$$E(\theta)=L(\theta)\cdot\cos^2\theta$$

In the case of a uniform illumination profile and for a spaced source, as mentioned previously, the illumination E(θ) becomes:

$$E(\theta)=L(\theta)\cdot\cos^2\theta=cste$$

namely $$L(\theta)=cste/\cos^2\theta=L(0)/s\cdot(s\cos\theta+\rho r\sin(\phi-\theta)-\rho r_0(\sin\phi_o-\theta)$$

Given that p(θ)=ρr·sin(φ−θ) and φ=2α+θ one derives the following differential equation:

$$d\alpha/d\theta=\sin\alpha\cdot\cos\alpha[d\log p(\theta)/d\theta]-\sin^2\alpha$$

Such a first order differential equation can be solved by giving a limit condition according to which a beam from the end 0 of the light source 3 nearest the reflective element 5, is reflected at Ro along a vertical, so that at this point $\theta=0$.

Suitable computation means thus permit computing each of the successive points of the reflective element 5 and hence tracing, preferably by automated means, the profile Roz of this latter. Obviously, the reflective element 5' will be constructed symmetrically.

As mentioned above, the present invention permits obtaining illumination curves of substantially any appearance.

There can for example thus be designed a light whose profile of the reflective elements will be such that the illumination falling on the target surface will be at each point proportional to the tangent of the angle $\theta$ formed by this point with the center of the light.

In such an arrangement, the illumination curve is defined by the equation: $E(\theta)=E(0)\cdot(1+\text{tg}\ \theta)$ which is valid between two end points C and C'.

There is respectively shown in FIGS. 7 and 8 such an illumination curve and the cross section of each of the reflective elements 5 and 5'.

In most of the possible uses of the invention, the light sources will not be flat sources but sources in the form of a cylinder of revolution, such as fluorescent tubes and the like. It is known optically that an equivalent of a flat source can be a cylindrical light source by providing the latter with a cylindrical reflector whose developed profile is a circle.

There is thus shown in FIG. 4 the cross section of a light, used according to the invention, and which is constituted by cylindrical elements. This light is comprised of a light source constituted by a cylindrical luminescent tube 4, a reflector 17 called a primary reflector, whose cross section is in the form of a developed circle, and two reflective elements 5, 5' which are symmetrical relative to the plane of symmetry P of the light source 4. The primary reflector 17 gives from the cylindrical light source 4 a rectangular image of width OO', which plays the role of a virtual light source relative to the reflective elements 5, 5'. Thereafter the construction of the reflective elements 5, 5' takes place as described above.

A drawback of this type of light is that the primary reflector 17, having the developed shape of a circle, increases substantially the height of the light. Means permitting reducing this size consists in truncating the base of the primary reflector 17, as shown in FIG. 5*a*, which permits displacing in an upstream direction (that is toward the top in the drawing) the downstream ends Ro of the reflective elements 5, 5'.

Tests carried out by the applicant have established that the best results are obtained when there is effected a truncation of each of the elements of circular development with a straight line forming, with the perpendicular xx' to the plane of symmetry P of the light, an angle $\beta$ of about 20°. The point of intersection of this straight line with the profile of circular development of the primary reflector 17 gives an end 0 to the virtual light source. From this point O one thus proceeds as previously indicated to determine the downstream end Ro of the profile of the reflective element 5.

It is moreover known that even if the fluorescent tubes do not ordinarily produce large quantities of heat, it is however sometimes necessary to space them from the reflectors, so as to avoid their deterioration under the effect of heat. When such a displacement is effected, the image 3' of the light source 4, playing the role of a virtual light source relative to the reflective elements 5, 5', is in that case not strictly isotropic, so that the resulting illumination curve distributed over the target surface 7 will be accordingly modified.

There is thus shown in FIG. 6 such a modification of the practice of the invention in which the external surface of a fluorescent tube 4 is spaced by a distance d from the bottom of the primary reflector 17. There is shown in dotted line on FIG. 5*b* the illumination curve supplied by such a light over the spaced target surface 7. It will be seen that in lieu of obtaining the desired profile, which is to say an illumination profile comprising a central plateau constituted by a straight line CC', there is obtained a curve CDC' whose concavity is directed upwardly.

The present invention permits acting on the shape of the reflective elements 5 and 5' to give them a correction returning the illumination curve to the desired straight line. To do this, there is introduced a new function, a so-called correction function $Fc(\theta)$, representing for each of the angles $\theta$ a correction factor to be given to the illumination function $L(\theta)$. At each of the points the correction factor $Fc(\theta)$ is equal to the ratio of the luminance which it is desired to obtain, to the obtained luminance (which it is desired to correct) $Fc(\theta)=HK/IK$. There is thus obtained a new function $L'(\theta)$ from which there is established as before a differential equation of the type of the preceding equation which defines the profile of each of the reflective elements 5, 5'.

Such a modification of the invention could of course be practiced with illumination curves other than linear.

One could also combine two different modes of embodiment of the invention, so as to provide particularly a light adapted, from a cylindrical or non-cylindrical light source in contact with the primary truncated reflector, on a target surface spaced from said source, an illumination curve of substantially any shape.

Although in the preceding examples the profile of the cross section of a reflective element has been formed beginning by determining its downstream end Ro, one could also of course proceed in the reverse fashion.

There is thus shown in FIG. 9 a light constituted by a light source 3' and two reflective elements 5 and 5' whose upstream ends Ro of the profiles are determined as before by the values $r_o$ of the distance of Ro to the end 0 of the cross section of the light source 3', and by the angle $\gamma$ from which will be seen, from the end Ro, the cross section s of the light source 3.

In this embodiment the illumination of the target surface is thus:

$$E(\theta)=L(\theta)\cdot\cos^2\theta=k[s\cdot\cos\theta-\rho r\cdot\sin(\phi-\theta)+\rho r_o\cdot\sin(\phi_o-\theta)]$$

We claim:

1. Process for the production of the profile of reflective elements of a light constituted by a flat light source (3, 3') symmetrical relative to a plane (P), of at least two cylindrical reflective elements (5, 5') having a coefficient of reflectivity ($\rho$), each point (R) of said profile being defined by the length (r) of the segment (RO) representing the distance from the end (0) of the cross section of said light source (3, 3'), located on the side of said reflective element (5, 5'), to said point (R), and by the angle ($\phi$) formed by the vertical with said segment (RO), the light beams from the light source (3, 3') forming, at the output of the light, respective angles ($\theta$) with said plane (P), characterized in that it comprises the steps consisting of:

defining the position of one end ($R_o$) of the profile of each reflective element (5, 5'), from on the one hand a desired distance ($r_0$) separating said end ($R_0$) from the end (0) of the cross section of said light source (3, 3') located on the side of said reflective element (5, 5') and, on the other hand, an angle ($\gamma$) over which it is desired to see the width (s) of said light source (3, 3') from the end ($R_o$) of said profile, a segment $R_oO$ forming with the vertical an angle ($\phi_o$).

defining an illumination function E(θ) corresponding to a desired illumination curve, connected to a luminance function L(θ) by the formula:

$$E(\theta)=L(\theta)\cdot\cos^2\theta=k[s\cdot\cos\theta+\rho r\cdot\sin(\phi-\theta)-\rho r_o\sin(\phi_o-\theta)]\cos^2\theta$$

if said end (Ro) of the profile of the reflective element (5, 5') is the downstream end of the latter, and an illumination function:

$$E(\theta)=L(\theta)\cdot\cos^2\theta=k[s\cdot\cos\theta-\rho r\cdot\sin(\phi-\theta)+\rho r_o\cdot\sin(\phi_o-\theta)]\cos^2\theta$$

if said end (Ro) is the upstream end of said profile, in which k=L(O)/s determining, from said end (Ro), the coordinates of each of the points (R) of said profile of each reflective element (5, 5') satisfying the differential equation:

$$d\alpha/d\theta=\sin\alpha\cdot\cos\alpha[d\log p(\theta)/d\theta]-\sin^2\alpha,$$

in which the function p(θ) is equal to pr·sin(ϕ−θ) and the value of the angle α is equal to (ϕ−θ)/r.

2. Process according to claim 1 characterized in that said flat light source (3, 3') is constituted of a virtual image obtained from a cylindrical light source (4) of circular section and from a primary reflector (17) whose shape is a circular development.

3. Process according to claim 2 characterized in that the external surface of said cylindrical light source (4) is spaced from the internal surface of the primary reflector (17) and, after having determined the illumination function (E(θ)) supplied by the light, an illumination correction function (Fc(θ)) is defined with which the illumination function (E(θ)) is modified.

4. Process according to claim 2 characterized in that there is effected a truncation of the primary reflector (17) by an angle (β) whose value is about 20°, wherein (β) is the angle between a first line defined by an end (0, 0') of said primary reflector (17) and an end of a said reflective element (5, 5') that intersects a Plane of symmetry (P) of said light at a point, and a second line (x, x') perpendicular to said plane (P) at said point.

5. Process according to claim 1 characterized in that there is given to the angle (γ) across which it is desired to see the width (s) of the light source (3, 3') from the end (Ro) of the profile of a reflective element (5, 5'), a value greater than that of the angle ($\theta_c$, θc') over which one sees, from the center of the light, each of the end points (C, C') of the target surface (7).

* * * * *